US009879416B2

(12) United States Patent
Spoo et al.

(10) Patent No.: US 9,879,416 B2
(45) Date of Patent: Jan. 30, 2018

(54) COMPOSITE THERMAL ISOLATING MASONRY TIE FASTENER

(71) Applicant: Owens Corning Intellectual Capital, LLC, Toledo, OH (US)

(72) Inventors: Kevin J. Spoo, Newark, OH (US); Neil Robert Hettler, Granville, OH (US); Herbert Ray Slone, Kent, OH (US); William Anthony Kunkler, Heath, OH (US); Matthew Gawryla, Chagrin Falls, OH (US); William James Ramsey, Tallmadge, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 0 days.

(21) Appl. No.: 14/944,673

(22) Filed: Nov. 18, 2015

(65) Prior Publication Data

US 2016/0076243 A1 Mar. 17, 2016

Related U.S. Application Data

(62) Division of application No. 14/533,254, filed on Nov. 5, 2014, now abandoned.
(Continued)

(51) Int. Cl.

| | |
|---|---|
| ***E04B 1/76*** | (2006.01) |
| ***E04B 1/41*** | (2006.01) |
| ***E04B 2/58*** | (2006.01) |

(52) U.S. Cl.
CPC ..... *E04B 1/7637* (2013.01); *E04B 1/40* (2013.01); *E04B 1/4178* (2013.01);
(Continued)

(58) Field of Classification Search
CPC ..... E04B 1/62; E04B 1/4178; E04B 1/7616; E04B 2/30; E04B 2/54; E04B 2/58
See application file for complete search history.

(56) References Cited

U.S. PATENT DOCUMENTS

| | | | |
|---|---|---|---|
| 4,875,319 | A | 10/1989 | Hohmann |
| 4,922,680 | A | 5/1990 | Kramer |

(Continued)

FOREIGN PATENT DOCUMENTS

| | | |
|---|---|---|
| CA | 1233351 | 3/1988 |
| CA | 2597736 | 10/2004 |

(Continued)

OTHER PUBLICATIONS

Brochure, Champion Fiberglass, Champion Strut, 2014, 16 pgs.
(Continued)

*Primary Examiner* — Patrick J Maestri
(74) *Attorney, Agent, or Firm* — Calfee, Halter & Griswold, LLP

(57) ABSTRACT

Cavity walls include fasteners that provide a thermal break. A cavity wall assembly includes a support structure, insulation, and an outer wythe. The insulation is mounted on the support structure. The outer wythe is spaced apart from the insulation, such that a cavity is formed between the insulation and the outer wythe. A tie is attached to the outer wythe. A fastener extends through a portion of the tie, through the insulation, and into the support structure to attach the tie to the support structure. The fastener provides a thermal break between the support structure and the tie. At least a portion of the thermal break is disposed within a width of the insulation.

10 Claims, 15 Drawing Sheets

Related U.S. Application Data

(60) Provisional application No. 61/900,449, filed on Nov. 6, 2013.

(52) U.S. Cl.
CPC ..... *E04B 1/7612* (2013.01); *E04B 1/7629* (2013.01); *E04B 2/58* (2013.01)

(56) References Cited

U.S. PATENT DOCUMENTS

| | | | | |
|---|---|---|---|---|
| 5,059,077 | A | 10/1991 | Schmid | |
| 5,118,235 | A | 6/1992 | Dill | |
| 5,626,451 | A | 5/1997 | Siebert | |
| 5,634,310 | A | 6/1997 | Hohmann | |
| 5,671,578 | A | 9/1997 | Hohmann | |
| 5,816,008 | A | 10/1998 | Hohmann | |
| 6,042,315 | A | 3/2000 | Miller et al. | |
| 6,045,310 | A | 4/2000 | Miller et al. | |
| 6,279,283 | B1 | 8/2001 | Hohmann | |
| 6,584,746 | B1 | 7/2003 | Hohmann | |
| 6,668,505 | B1 | 12/2003 | Hohmann | |
| 6,789,365 | B1 | 9/2004 | Hohmann | |
| 6,851,239 | B1 | 2/2005 | Hohmann | |
| 6,928,780 | B1 | 8/2005 | Hohmann | |
| 7,325,366 | B1 | 2/2008 | Hohmann | |
| 2002/0100239 | A1 | 8/2002 | Lopez | |
| 2003/0037506 | A1 | 2/2003 | Seibert | |
| 2004/0216408 | A1 | 11/2004 | Hohmann | |
| 2005/0183261 | A1 | 8/2005 | Nebesnak | |
| 2005/0201845 | A1 | 9/2005 | Keener | |
| 2006/0005490 | A1 | 1/2006 | Hohmann | |
| 2006/0277855 | A1 | 12/2006 | Westra | |
| 2008/0295651 | A1* | 12/2008 | Nilsen | B25B 13/065 81/180.1 |
| 2009/0133357 | A1* | 5/2009 | Richards | E04B 1/4178 52/698 |
| 2009/0151296 | A1 | 6/2009 | Perry | |
| 2011/0047919 | A1* | 3/2011 | Hohmann, Jr. | E04B 1/4178 52/513 |
| 2012/0216471 | A1 | 8/2012 | Manser | |
| 2015/0121792 | A1 | 5/2015 | Spoo | |

FOREIGN PATENT DOCUMENTS

| | | |
|---|---|---|
| CA | 2458012 | 11/2004 |
| CA | 2690819 | 6/2008 |
| CN | 200982334 | 11/2007 |
| CN | 201043342 | 4/2008 |
| DE | 3321623 | 8/1984 |
| DE | 3916515 | 11/1990 |
| DE | 4041819 | 6/1992 |
| DE | 19629180 | 1/1998 |
| DE | 10010473 | 9/2001 |
| DE | 102005000147 | 5/2007 |
| DE | 102009006769 | 8/2010 |
| EP | 132389 | 1/1985 |
| EP | 187168 | 7/1986 |
| EP | 544054 | 6/1993 |
| EP | 591080 | 4/1994 |
| EP | 726372 | 8/1996 |
| EP | 819807 | 1/1998 |
| EP | 1050690 | 11/2000 |
| EP | 1518971 | 3/2005 |
| EP | 1624199 | 2/2006 |
| EP | 1978177 | 10/2008 |
| EP | 2039847 | 3/2009 |
| EP | 1693530 | 8/2010 |
| GB | 2470230 | 11/2010 |
| WO | 00/012823 | 3/2000 |
| WO | 01/083178 | 11/2001 |
| WO | 06/056062 | 6/2006 |
| WO | 08/017347 | 2/2008 |
| ZA | 98/2393 | 9/1998 |

OTHER PUBLICATIONS

Brochure, Professional Plastics, Thermal Properties of Plastic Materials, 4 pages, date at least as early as the filing date of this application.

Molded Fiber Glass Companies, Technical Design Guide for FRP Composite Products and Parts, 25 pages, date at east as early as the filing of this application.

Rochling Engineering Plastics, Fasteners, Durostone, 20 pages, date at least as early as the filing date of this application.

Hagel, et al., "Comparison of theoretical and empirically determined service lives for wall ties in brick veneer steel stud wall systems", Can. J. Civ. Eng. 34: 1424-1432 (2007).

Notice of Abandonment from U.S. Appl. No. 14/533,254 dated Dec. 4, 2015.

Office action from U.S. Appl. No. 14/533,254 dated May 18, 2015.

* cited by examiner

COMPOSITE THERMAL ISOLATING MASONRY TIE FASTENER

RELATED APPLICATIONS

The present application is a divisional of U.S. patent application Ser. No. 14/533,254, filed on Nov. 5, 2014, titled "Composite Thermal Isolating Masonry Tie Fastener," which claims the benefit of U.S. Provisional Patent Application Ser. No. 61/900,449, filed on Nov. 6, 2013, the disclosures of which are each incorporated herein by reference in their entireties.

FIELD OF THE INVENTION

The present inventions relate to thermally isolated anchoring systems for insulated walls. In particular, the present invention relates to anchoring systems that minimize heat transfer through a fastener that extends through an insulation material.

BACKGROUND OF THE INVENTION

Published US Patent Application Pub. No. 2011/0047919 provides a background of anchoring systems. Portions of US Patent Application Pub. No. 2011/0047919 are incorporated below. US Patent Application No. 2011/0047919 is incorporated herein by reference in its entirety.

In the past, anchoring systems have taken a variety of configurations. The construction of a steel frame of a commercial or residential building, to which masonry veneer is attached, uses steel studs with insulation installed outboard of the steel stud framing. Steel anchors and ties attach the outer masonry wythe to the inner steel stud framing by screwing or bolting an anchor to a steel stud. Steel is an extremely good conductor of heat. The use of steel anchors attached to steel framing draws heat from the inside of a building through the exterior sheathing and insulation, towards the exterior of the masonry wall. US Patent Application No. 2011/0047919 recognizes that in order to maintain high insulation values, a thermal break or barrier is needed between the steel framing and the outer wythe.

SUMMARY

The present application discloses fasteners that provide a thermal break in cavity walls. In one exemplary embodiment, a cavity wall assembly includes a support structure, insulation, and an outer wythe. The insulation is mounted on the support structure. The outer wythe is spaced apart from the insulation, such that a cavity is formed between the insulation and the outer wythe. A tie is attached to the outer wythe. A fastener extends through a portion of the tie, through the insulation, and into the support structure to attach the tie to the support structure. The fastener provides a thermal break between the support structure and the tie. For example, in one exemplary embodiment, at least a portion of the thermal break is disposed within a width of the insulation.

BRIEF DESCRIPTION OF THE DRAWINGS

In the accompanying drawings which are incorporated in and constitute a part of the specification, embodiments of the invention are illustrated, which, together with a general description of the invention given above, and the detailed description given below, serve to provide examples of the principles of this invention.

DETAILED DESCRIPTION

As described herein, when one or more components are described as being connected, joined, affixed, coupled, attached, or otherwise interconnected, such interconnection may be direct as between the components or may be indirect such as through the use of one or more intermediary components. Also as described herein, reference to a "member," "component," or "portion" shall not be limited to a single structural member, component, or element but can include an assembly of components, members or elements.

In the embodiments described herein, the inner wythe is provided with insulation. In exemplary embodiments disclosed herein, the insulation is applied to the outer surface thereof of sheathing and/or drywall. Anchoring systems for cavity wall assemblies are used to secure veneer facings to a building and overcome seismic and other forces, i.e. wind shear, etc.

Figure 3:
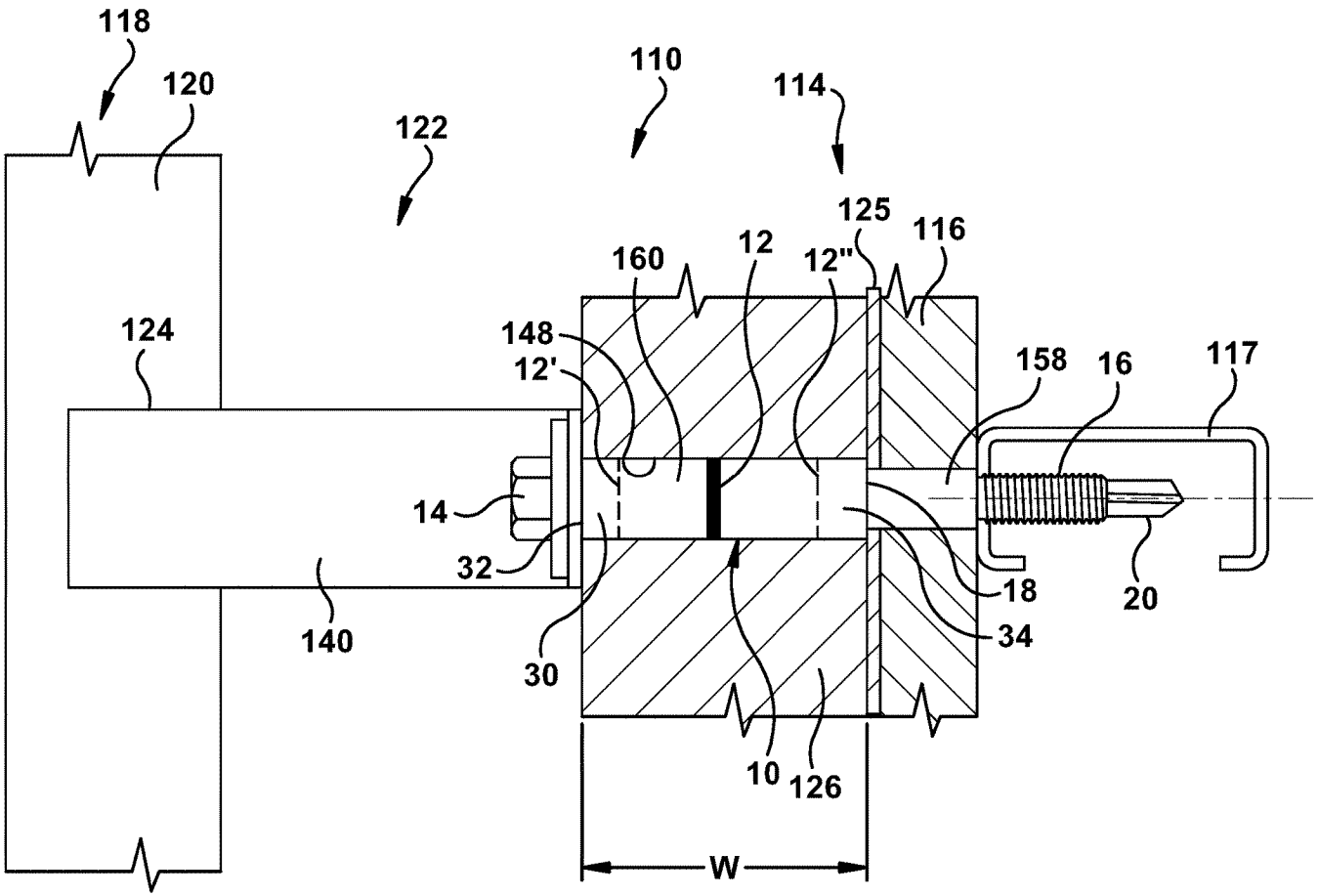
FIG. 3 is a cross-sectional view of FIG. 2 taken along an xz-plane including the longitudinal axis of the fastener.

Exemplary embodiments of wall anchoring systems 110 are disclosed in the present application. Each of the wall anchoring systems include a fastener 10. The fastener 10 can take a wide variety of different forms. In the examples illustrated by FIGS. 1, 1A, and 1B, the fastener 10 includes a thermal break 12 or the fastener can be made from a material having a low thermal conductivity, such as plastic (See FIGS. 1C an 1D) that provide a thermal break. The thermal break 12 can take a wide variety of different forms. Referring to FIG. 3, in one exemplary embodiment, the thermal break 12 is positioned on the fastener 10, such that the thermal break is positioned within the width W of the insulation 126. In one exemplary embodiment, the thermal break is provided across the entire width W of the insulation 126. For example, the fasteners 10 illustrated by FIGS. 1C and 1D that are made from plastic provide a thermal break across the entire width of the insulation. In another embodiment, the entire portion of the fastener 10 that is within the width W of the insulation 126 provides a thermal break, while one or more other portions of the fastener are conductive.

In the exemplary embodiments illustrated by FIGS. 1, 1A, 1B, 1C, and 1D, the fastener 10 includes a head 14, a threaded portion 16, and an optional unthreaded shank 18. In another exemplary embodiment, the entire length of the fastener 10 is threaded. In the examples illustrated by FIGS. 1, 1A, and 1B, the fastener 10 includes a thermal break. One or more thermal breaks 12 can be positioned anywhere along the threaded portion 16 and/or the unthreaded shank 18. The thermal breaks can take a wide variety of different forms. In one exemplary embodiment, the thermal break 12 is between 0.010 and 0.500 inches wide (i.e. along the axis of the fastener).

Figure 1:
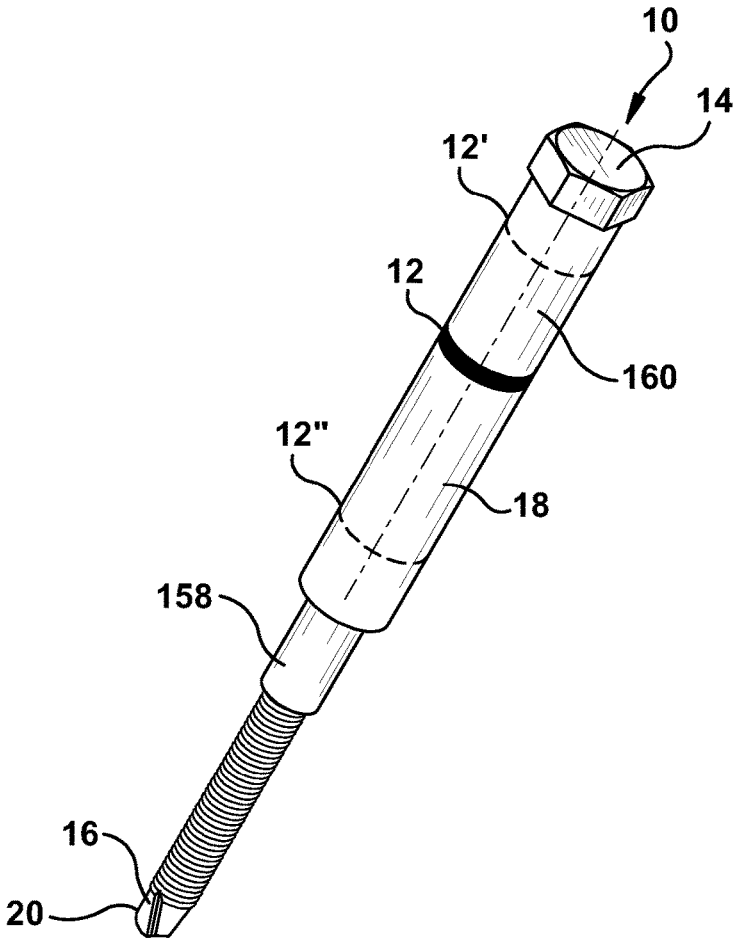
FIG. 1 is a perspective view of an exemplary embodiment of a fastener with a thermal break.
Figure 1A:
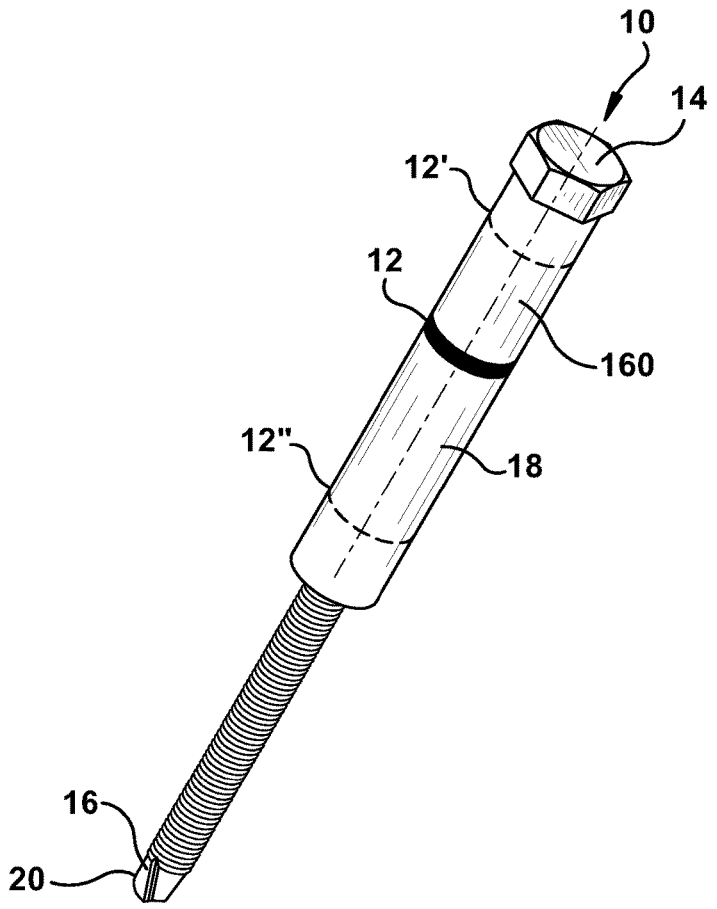
FIG. 1A is a perspective view of another exemplary embodiment of a fastener with a thermal break.
Figure 1B:
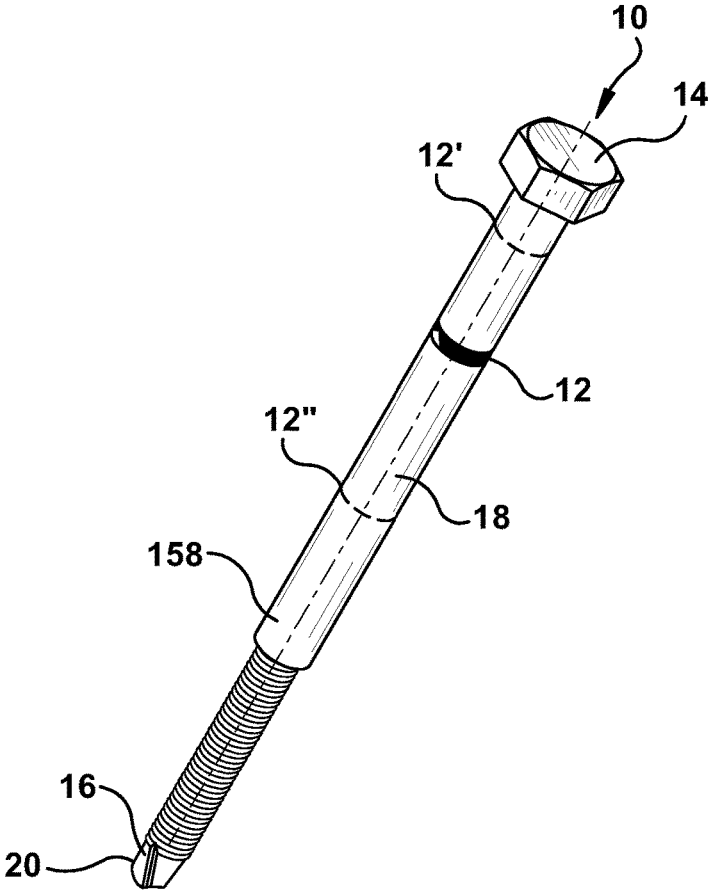
FIG. 1B is a perspective view of another exemplary embodiment of a fastener with a thermal break.
Figure 1C:
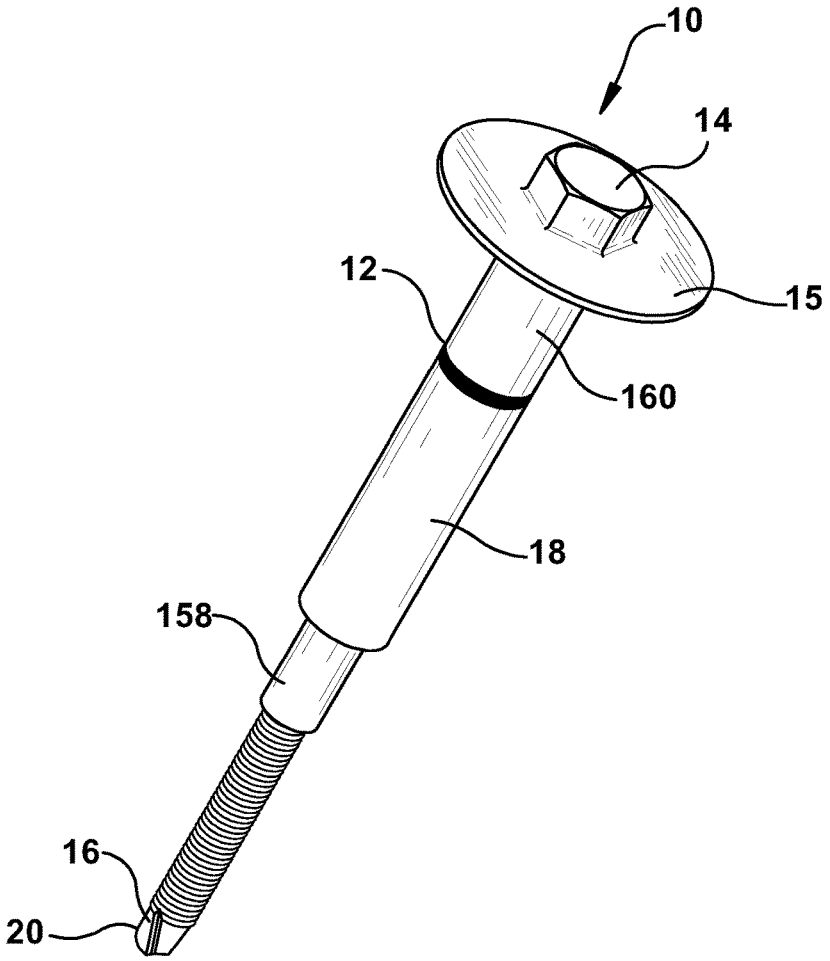
FIG. 1C is a perspective view of another exemplary embodiment of a fastener that provides a thermal break.
Figure 1D:
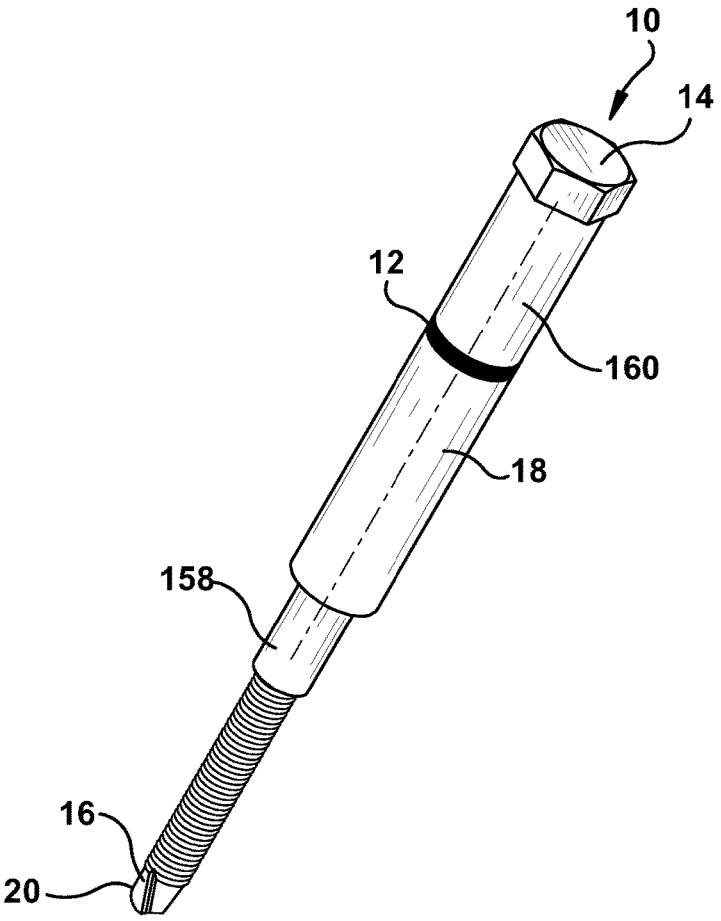
FIG. 1D is a perspective view of another exemplary embodiment of a fastener that provides a thermal break.

In the examples illustrated by FIGS. 1C and 1D, the entire head 14 and/or the entire optional shank 18 are made from a non-thermally conductive material, such as plastic, such that the entire unthreaded shank 18 provides a thermal break. In one exemplary embodiment, the entire head 14, the entire optional shank 18, and the entire threaded portion are made from a non-thermally conductive material, such as plastic, such that the entire fastener provides a thermal break.

The head 14 can take a wide variety of different forms. For example, the head 14 can be a head that is configured to be driven by a conventional driver, such that a special tool is not required. For example, the illustrated head 14 has a hexagonal configuration for driving with a wrench or socket. The head could also be configured to accept a bit, such as a blade bit, a Phillips head bit, a hex bit, a torqx bit, etc. In another exemplary embodiment, the head 14 is configured for attachment to a veneer tie (See, for example, FIG. 6 of US Patent No. 2011/0047919). Referring to FIG. 1C, in one exemplary embodiment the head 14 includes an integral large washer 15. The integral large washer 15 may be included on any of the fasteners 10 illustrated by FIGS. 1, 1A, 1B, and 1D. Incorporating the large washer 15 directly on the fastener makes the fastener easier to install, since there are fewer steps and pieces. In one exemplary embodiment, the integral large washer 15 can include any of the features of the tie retaining devices 440, 540 or the composite tie 840 described below. In one exemplary embodiment, the diameters of the washers disclosed by this application are at least twice as large as the largest diameter of the hexagonal (or other shape) of the driven portion of the head. For example, the washers disclosed by this application can be between 1" and 3" in diameter. The large washer 15 (or the washers of the retaining devices 440, 540 or the composite tie 840) distribute load when a pressure differential is present on the foam (i.e. wind load).

The threaded portion 16 can take a wide variety of different forms. In the examples illustrated by FIGS. 1, 1A, and 1B, the threaded portion 16 has a cutting end 20 that is configured to cut through a metal stud 117 (See FIG. 3) and threads 22 that are configured to secure the fastener 10 to the metal stud. In another exemplary embodiment, the threaded portion 16 is configured to cut into wood, for example a wood stud or panel, or masonry, for example cinder block or poured concrete. However, the threaded portion can take any form that secures the fastener 10 to the metal stud. For example, in one exemplary embodiment, the cutting end 20 can be omitted.

The unthreaded shank 18 can take a wide variety of different forms. In the example illustrated by FIG. 1, the unthreaded shank 18 includes a large diameter portion 160 and a small diameter portion 158. In the example illustrated by FIG. 1A, the unthreaded shank 18 includes only a large diameter portion 160. In the example illustrated by FIG. 1B, the unthreaded portion 18 includes only a small diameter portion 158, such that a portion that is approximately the same diameter as the major or maximum diameter of the threaded portion 16. However, when included, the unthreaded shank 18 can take any form.

Figure 2:
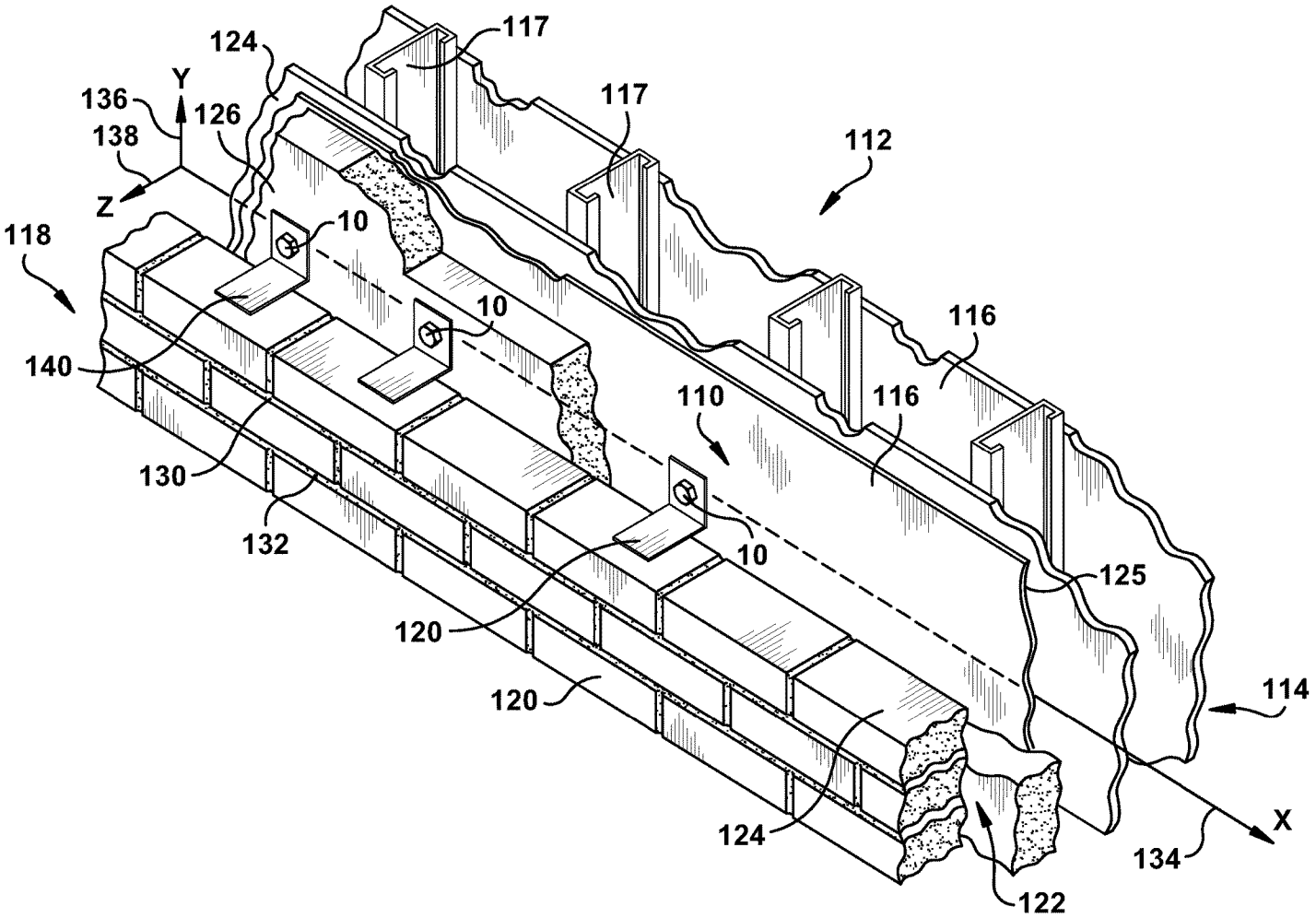
FIG. 2 is a perspective view of an exemplary embodiment of an anchoring system that uses a fastener illustrated by FIG. 1, FIG. 1A, and/or FIG. 1B applied to a cavity wall assembly with an inner support structure, one or more layers of exterior sheathing, and an outer wythe of brick.

FIGS. 2 and 3 illustrate an exemplary embodiment of an anchoring system 110. This anchoring system 110 includes a fastener 10, and a veneer tie 140. A cavity wall assembly 112 is shown as having an inner wythe 114 constructed from one or more panels 116 or layers, which may be sheetrock, drywall, particle board, oriented strand board, fiberglass mats on the front and back of a fiberglass reinforced gypsum core, and/or any other wall construction panel or facing material, mounted on a support structure 117, such as a metal stud or column, a wood support structure, such as a wood stud or panel, and/or a masonry support structure, such as a cinder block or poured concrete. The illustrated support structure 117 is a metal stud, but inner wythes constructed of masonry materials and/or wood framing (not shown) are also applicable. The cavity wall assembly also includes an outer wythe or facing wall 118 of brick 120 construction. Between the inner wythe 114 and the outer wythe 118, a cavity 122 is formed. The cavity 122 has attached to the exterior surface 124 of the inner wythe 114 an optional air or air-vapor barrier 125 and insulation 126. The barrier 125 may be an air barrier, an air and vapor barrier, and/or an air barrier and vapor retarder with some vapor permeance, such as about 1 perm. The air or air-vapor barrier 125 and/or the panel 116 form an exterior layer of the inner wythe 114, which exterior layer has the insulation 126 disposed thereon. The insulation 126 can take a wide variety of different forms. Rigid foam insulation boards are illustrated, but the insulation 126 can take any form.

Successive bed joints 130 and 132 may be substantially planar and horizontally disposed, in accord with current building standards. For example, the bed joints may be 0.375-inch (approx.) in height. Selective ones of bed joints 130 and 132, which are formed between courses of bricks 120, are constructed to receive a veneer anchor 140. The veneer anchor can take a wide variety of different forms. In the example illustrated by FIG. 2, any veneer anchor 140 capable of being mounted to the inner wythe 114 and insulation 126 with a conventional fastener or can be mounted with one of the fasteners 10 having a thermal break 12 illustrated by FIGS. 1, 1A, and 1B. In the exemplary embodiment illustrated by FIG. 2, the veneer anchor 140 is a simple "L" shaped metal bracket or strap. Being threadedly mounted in the inner wythe, the fastener 10 and tie or anchor 140 is supported. Referring to FIGS. 2 and 3, at intervals along a horizontal surface 124, fasteners 10 and ties or anchors 140 are driven into place in holes 148 in the insulation. The ties 140 are positioned on surface 124 so that the longitudinal axis of the fastener 10 is normal to an xy-plane and taps into column 117.

For purposes of discussion, the cavity surface 124 of the inner wythe 114 contains a horizontal line or x-axis 134 and intersecting vertical line or y-axis 136. A horizontal line or z-axis 138, normal to the xy-plane, passes through the coordinate origin formed by the intersecting x- and y-axes. FIG. 3 is a sectional view taken through this xz plane. As can be seen in FIG. 3, the location of the thermal break 12 is inside the width W of the insulation 126 in an exemplary embodiment. This positioning of the thermal break 12 inside the insulation significantly reduces heat transfer from one side of the insulation to the other side of the insulation. For example, in the winter the temperature inside a building and thus the temperature of the support structure 117 may be a room temperature between 65 and 75 degrees F., while the temperature of the outer wythe 118 and the cavity 122 may be below freezing. If a conventional metal fastener that does not have a thermal break within the width of the insulation 126, heat will conduct from the support structure 117, such as a metal stud, directly through the fastener, to the head of the fastener, and be lost in the cavity 122 that is much colder than the support structure 117. By providing a fastener 10 with a thermal break 12 within the width of the insulation 126, heat will conduct from the support structure 117, such as a metal stud and into the fastener, but the thermal break substantially prevents heat from passing to the head of the fastener, and from being lost in the colder cavity 122.

In an exemplary embodiment, one or more thermal breaks 12 can be positioned anywhere in the insulation 126. In the example illustrated by FIG. 3, thermal break(s) can be positioned as indicated by reference numbers 12, 12' and/or 12". Any number of thermal breaks can be provided. In the illustrated embodiment, the fastener 10 includes a metallic portion 30 that extends into the insulation 126 from the outside 32 and a metallic portion 34 that extends into the insulation 126 from the inside, with one or more thermal breaks 12, 12', and/or 12" disposed completely in the insulation.

The thermal break 12 can take a wide variety of different forms. For example, two or more parts of the fastener 10 can be connected by a material having a low thermal conductivity to form the thermal break 12. For example, the two or more parts can be connected together by an epoxy or other adhesive having a low thermal conductivity, mechanically connected together, for example by one or more threaded connectors having a low thermal conductivity, and the like. Any manner for providing a thermal break can be implemented. In another exemplary embodiment, the entire fastener 10 is made from a material having a low thermal conductivity, rather than providing a thermal break.

Figure 4B:
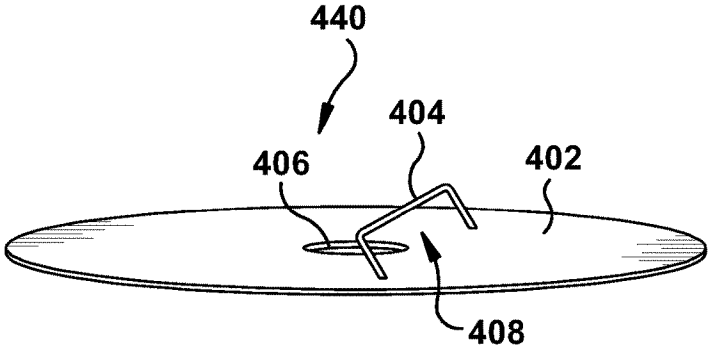
FIG. 4B is a perspective view of the veneer tie illustrated by FIG. 4A.
Figure 4A:
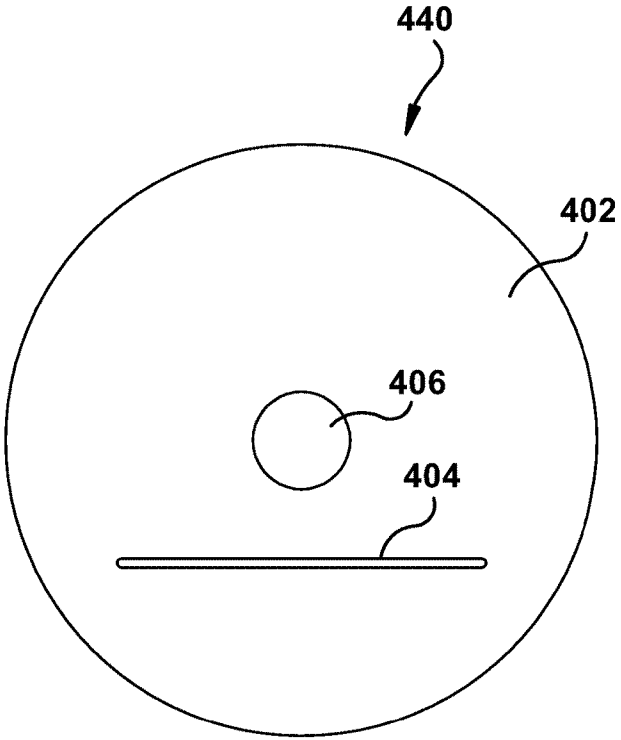
FIG. 4A is a top view of an exemplary embodiment of a veneer tie.

FIGS. 4A and 4B illustrate an exemplary embodiment of a tie retaining device 440 that can be used with a conventional fastener, such as a threaded fastener, or any of the fasteners 10 disclosed by the present application and a conventional tie. The illustrated tie retaining device comprises a disk 402 and a tie retainer 404. In an exemplary embodiment, the disk 402 is made from a material that is substantially non-conductive, such as plastic. The disk 402 includes a central hole 406 that is sized to accept threaded portion 16 and shank 18 of the fastener and such that the head 14 engages the disk 402. The tie retainer 404 extends away from the disk 402 to provide an opening 408 for an end (See the strap tie 140 illustrated by FIG. 2) or legs 610 of a tie (See FIG. 6).

If a conventional metal fastener is used directly with the metal tie strap 140 illustrated by FIGS. 2 and 3, heat will conduct from the support structure 117, such as a metal stud, directly through the fastener and the metal strap 140, and be lost in the cavity 122 and the outer wythe 118 that are much colder than the support structure 117. By using the retaining device 440 with a conventional fastener or a fastener 10 and a metal tie 140, a thermal break is provided between the metal tie 140 and the conventional fastener or a fastener 10. The plastic material of the disk 402 provides the thermal break.

Figure 5B:
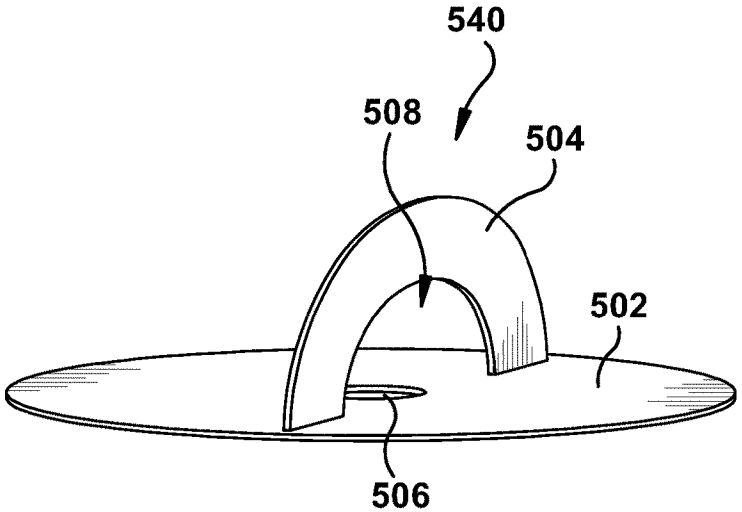
FIG. 5B is a perspective view of the veneer tie illustrated by FIG. 5A.
Figure 5A:
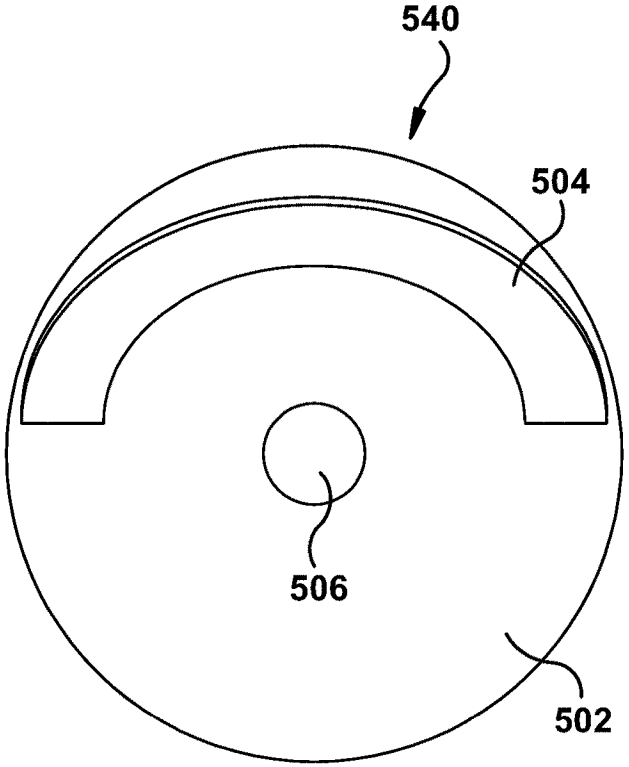
FIG. 5A is a top view of another exemplary embodiment of a veneer tie.

FIGS. 5A and 5B illustrate another exemplary embodiment of a tie retaining device 540 that can be used with a conventional fastener, such as a threaded fastener, or any of the fasteners 10 disclosed by the present application and a conventional tie. The illustrated tie retaining device comprises a disk 502 and a tie retainer 504. In an exemplary embodiment, the disk 502 and the tie retainer 504 are made from a material that is substantially non-conductive, such as plastic. The disk 502 includes a central hole 506 that is sized to accept the threaded portion 16 and shank 18 of the fastener 10, such that the head 14 engages the disk 402. The tie retainer 504 extends away from the disk 502 to provide an opening 508 for an end of a strap tie 140 (See FIG. 2) or legs (See FIG. 6) of a tie 140.

If a conventional metal fastener is used directly with the metal tie strap 140 illustrated by FIGS. 2 and 3, heat will conduct from the support structure 117, such as a metal stud, directly through the fastener and the metal strap, and be lost in the cavity 122 and the outer wythe 118 that are much colder than the support structure 117. By using the retaining device 540 with a conventional fastener or a fastener 10 and a metal tie 140, a thermal break is provided between the metal tie 140 and the conventional fastener or a fastener 10. The plastic material of the disk 502 and the tie retainer 504 provide the thermal break.

Figure 6:
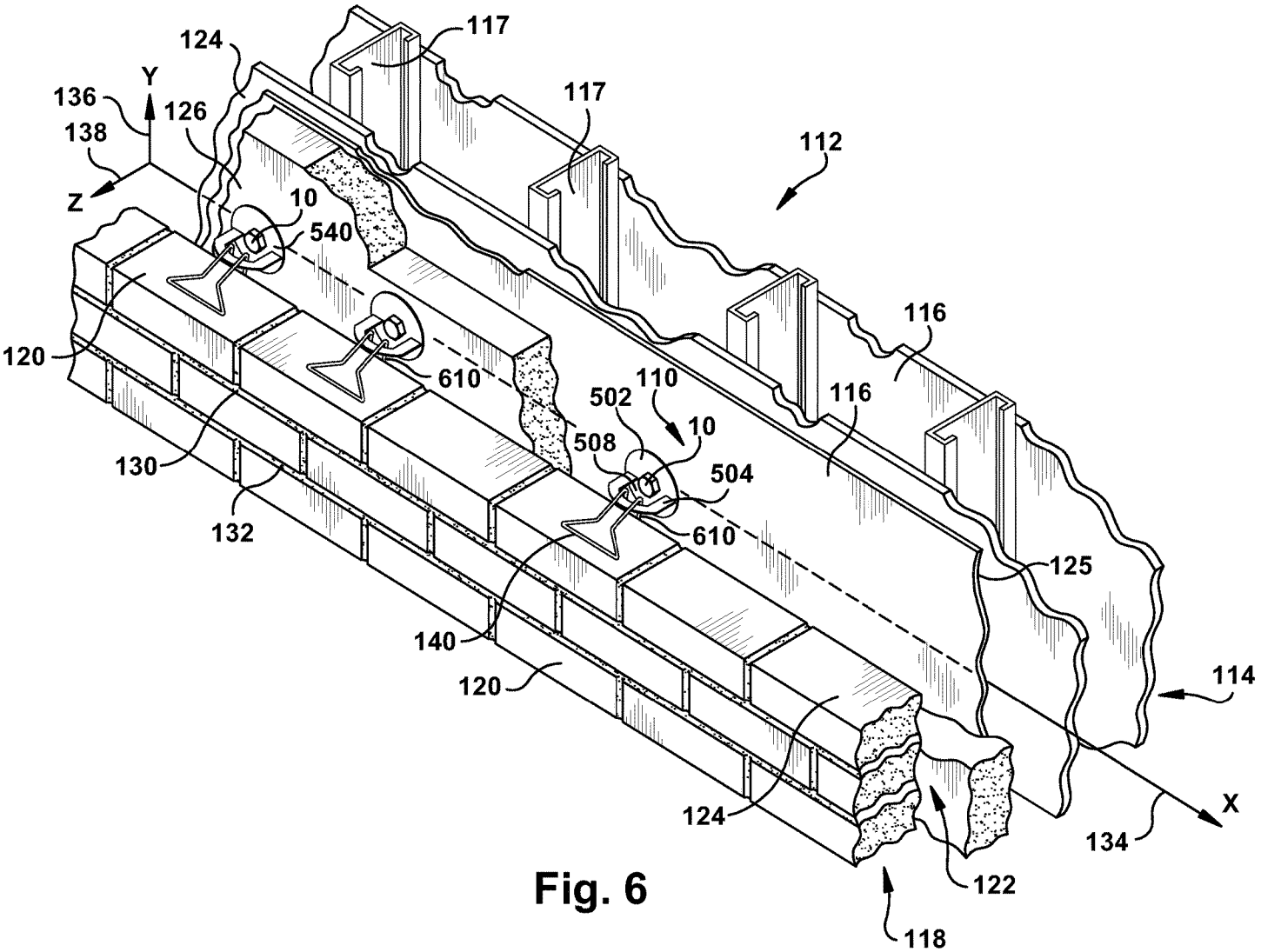
FIG. 6 is a perspective view of an exemplary embodiment of an anchoring system that uses a fastener illustrated by FIG. 1, FIG. 1A, and/or FIG. 1B and/or a veneer tie illustrated by FIGS. 5A, and 5B applied to a cavity wall assembly with an inner support structure, one or more layers of exterior sheathing, and an outer wythe of brick.
Figure 7:
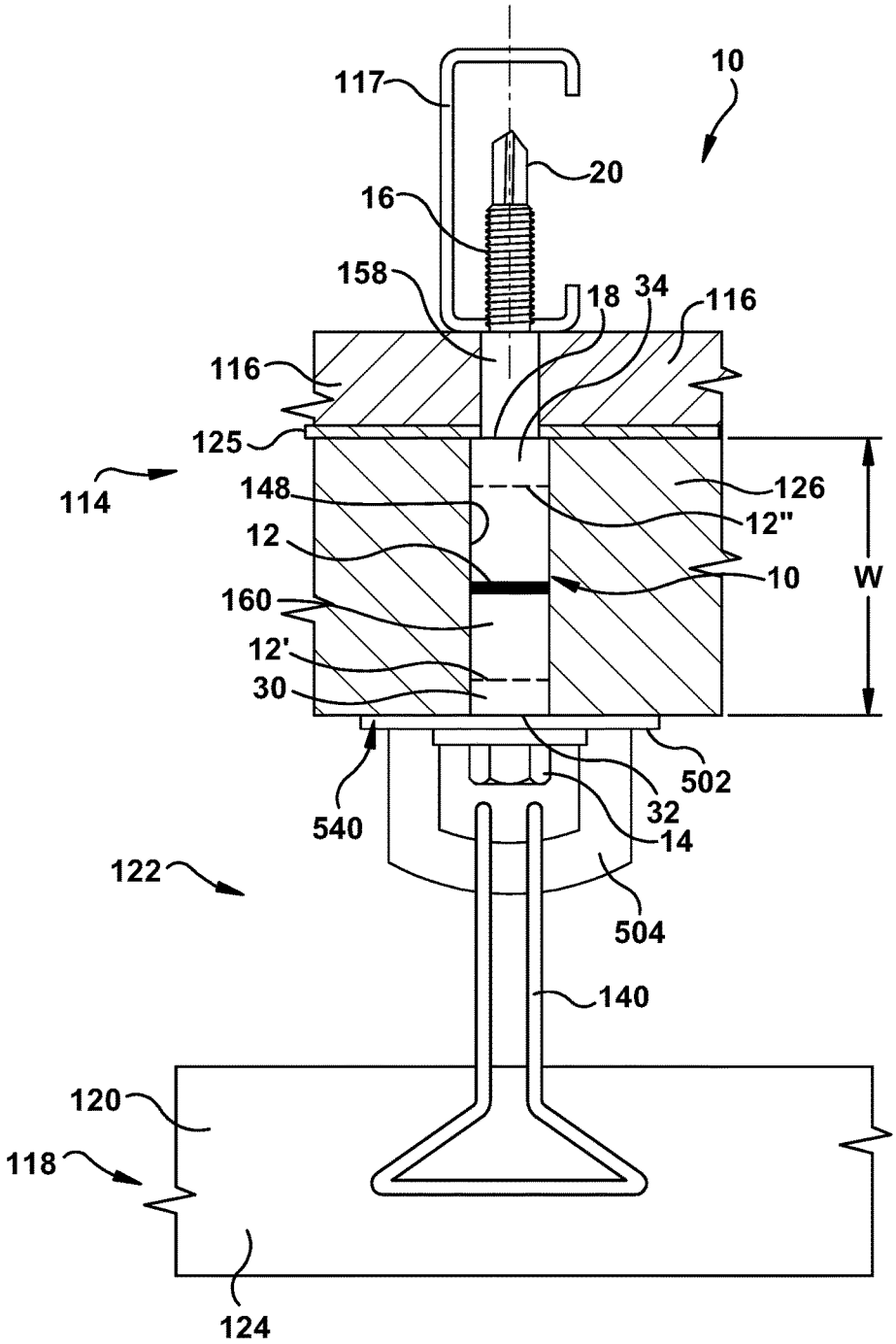
FIG. 7 is a cross-sectional view of FIG. 7 taken along an xz-plane including the longitudinal axis of the fastener.

FIGS. 6 and 7 illustrate a wall anchoring system 610 that uses fasteners 10 shown in FIGS. 1, 1A and/or 1B and the tie retaining device 540 illustrated by FIG. 5. A cavity wall assembly 112 is shown as having an inner wythe 114 constructed from one or more panels 116 or layers, which may be sheetrock, drywall, particle board, oriented strand board, fiberglass mats on the front and back of a fiberglass reinforced gypsum core, and/or any other wall construction panel or facing material, mounted on a support structure 117, such as metal studs-117. Inner wythes constructed of masonry materials and/or wood framing (not shown) are also applicable. The cavity wall assembly also includes an outer wythe or facing wall 118 of brick 120 construction. Between the inner wythe 114 and the outer wythe 118, a cavity 122 is formed. The cavity 122 has attached to the exterior surface 124 of the inner wythe 114 an optional air or air-vapor barrier 125 and insulation 126. The air or air-vapor barrier 125 and/or the panel 116 form an exterior layer of the inner wythe 114, which exterior layer has the insulation 126 disposed thereon.

Successive bed joints 130 and 132 may be substantially planar and horizontally disposed, in accord with current building standards. For example, the bed joints may be 0.375-inch (approx.) in height. Selective ones of bed joints 130 and 132, which are formed between courses of bricks 120, are constructed to receive a veneer anchor or tie 140.

The veneer anchor or tie can take a wide variety of different forms. In the example illustrated by FIG. 6, any veneer anchor 140 capable of being mounted to the inner wythe 114 and insulation 126 with a conventional fastener or can be mounted with one of the fasteners 10 having a thermal break 12 illustrated by FIGS. 1, 1A, and 1B can be used. In the exemplary embodiment illustrated by FIG. 6, the veneer tie 140 is a formed from wire with legs 610 that fit in the opening 508. The veneer tie 140 is shown in FIG. 1 on a course of bricks 120 in preparation for embedment in the mortar of a bed joint 130.

Referring to FIGS. 6 and 7, at intervals along a horizontal surface 124, fasteners 10 are driven into place in holes 148 in the insulation. The ties 140 are positioned on surface 124 so that the longitudinal axis of wall anchor 140 is normal to an xy-plane and the fastener 10 taps into column 117. For purposes of discussion, the cavity surface 124 of the inner wythe 114 contains a horizontal line or x-axis 134 and intersecting vertical line or y-axis 136. A horizontal line or z-axis 138, normal to the xy-plane, passes through the coordinate origin formed by the intersecting x- and y-axes. FIG. 7 is a sectional view taken through this xz plane. As can be seen in FIG. 7, the location of the thermal break 12 is inside the width W of the insulation 126 in an exemplary embodiment. This positioning of the thermal break 12 inside the insulation significantly reduces heat transfer from one side of the insulation to the other side of the insulation. For example, in the winter the temperature inside a building and thus the temperature of the support structure 117, such as a metal stud, may be a room temperature between 65 and 75 degrees F., while the temperature of the outer wythe 118 and the cavity 122 may be below freezing. If a conventional metal fastener that does not have a thermal break within the width of the insulation 126, heat will conduct from the support structure 117, such as a metal stud, directly through the fastener, to the head of the fastener, and be lost in the cavity 122 that is much colder than the support structure 117. By providing a fastener 10 with a thermal break 12 within the width of the insulation 126, heat will conduct from the support structure 117, such as a metal stud and into the fastener, but the thermal break substantially prevents heat from passing to the head of the fastener, and from being lost in the colder cavity 122.

In an exemplary embodiment, one or more thermal breaks 12 can be positioned anywhere in the insulation 126. In the example illustrated by FIG. 7, thermal break(s) can be positioned as indicated by reference numbers 12, 12' and/or 12". Any number of thermal breaks can be provided. In the illustrated embodiment, the fastener 10 includes a metallic portion 30 that extends into the insulation 126 from the outside 32 and a metallic portion 34 that extends into the insulation 126 from the inside, with one or more thermal breaks 12, 12', and/or 12" disposed completely in the insulation.

The thermal break 12 can take a wide variety of different forms. For example, two or more parts of the fastener 10 can be connected by a material having a low thermal conductivity to form the thermal break 12. For example, the two or more parts can be connected together by an epoxy or other adhesive having a low thermal conductivity, mechanically connected together, for example by one or more threaded connectors having a low thermal conductivity, and the like. Any manner for providing a thermal break can be implemented. In another exemplary embodiment, the entire fastener 10 is made from a material having a low thermal conductivity, rather than providing a thermal break.

Figure 8A:
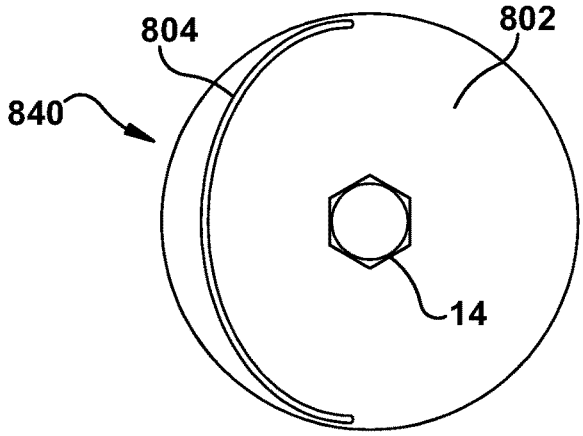
FIG. 8A is a top view of another exemplary embodiment of a veneer tie.
Figure 8B:
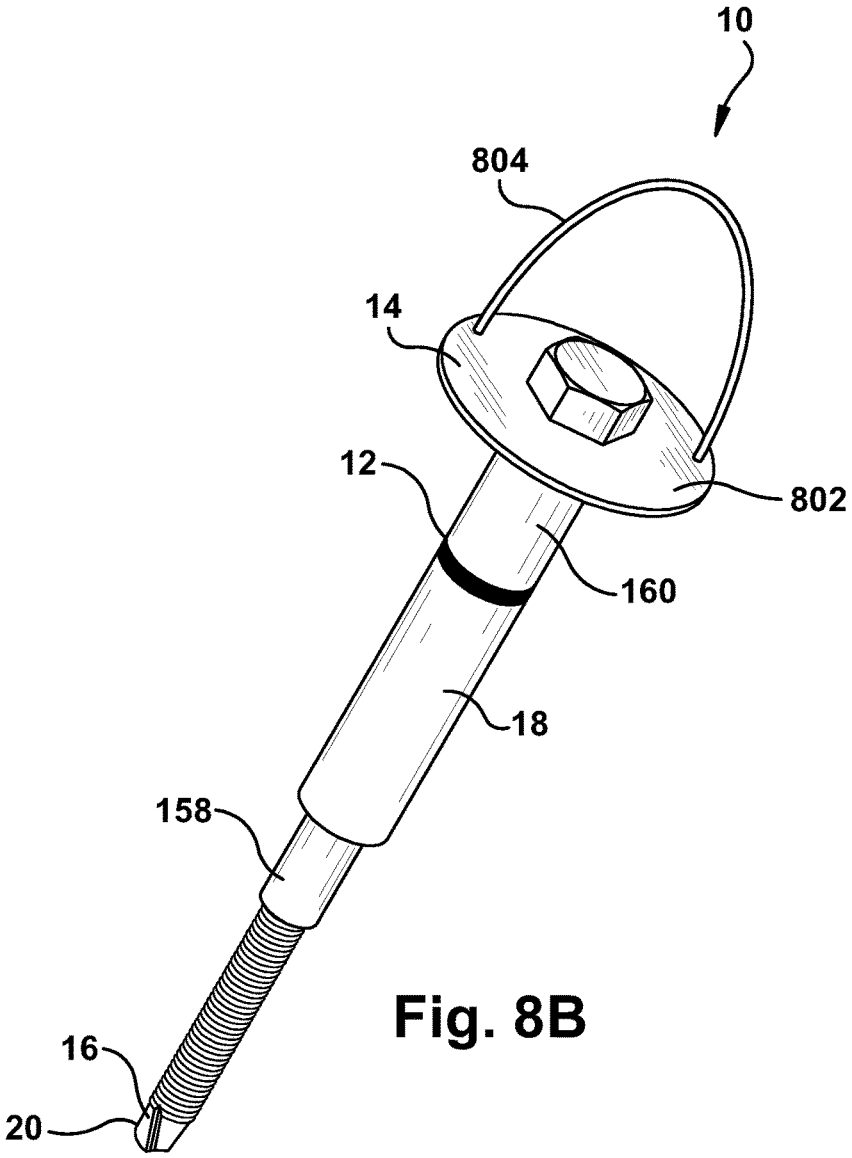
FIG. 8B is a perspective view of the veneer tie illustrated by FIG. 8A.

FIGS. 8A and 8B illustrate an exemplary embodiment of a composite tie 840 that can be used with a conventional fastener, such as a threaded fastener, or any of the fasteners 10 disclosed by the present application. The illustrated composite tie 840 comprises a disk 802 and a wire loop 804. In an exemplary embodiment, the disk 802 is made from a material that is substantially non-conductive, such as plastic. The disk 802 includes a central hole 806 that is sized to accept the threaded portion 16 and shank 18 of the fastener 10, such that the head 14 engages the disk 802. The tie retainer wire loop 804 extends away from the disk 802. The disk 802 provides a thermal break between the fastener 10 or a conventional fastener and the tie retainer wire loop 804.

Figure 9:
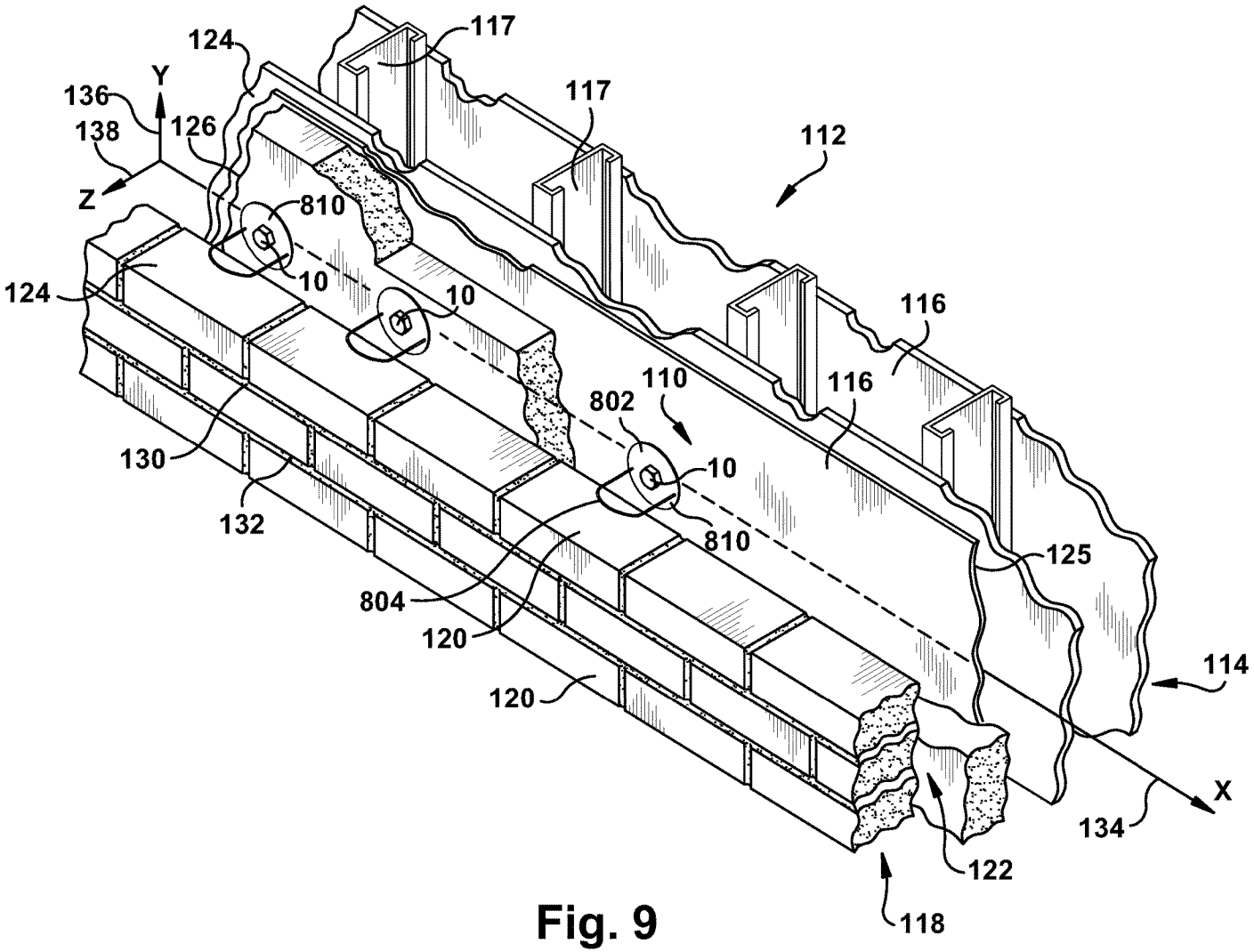
FIG. 9 is a perspective view of an exemplary embodiment of an anchoring system that uses a fastener illustrated by FIG. 1, FIG. 1A, and/or FIG. 1B and/or a veneer tie illustrated by FIGS. 8A and 8B applied to a cavity wall assembly with an inner support structure, one or more layers of exterior sheathing, and an outer wythe of brick.
Figure 10:
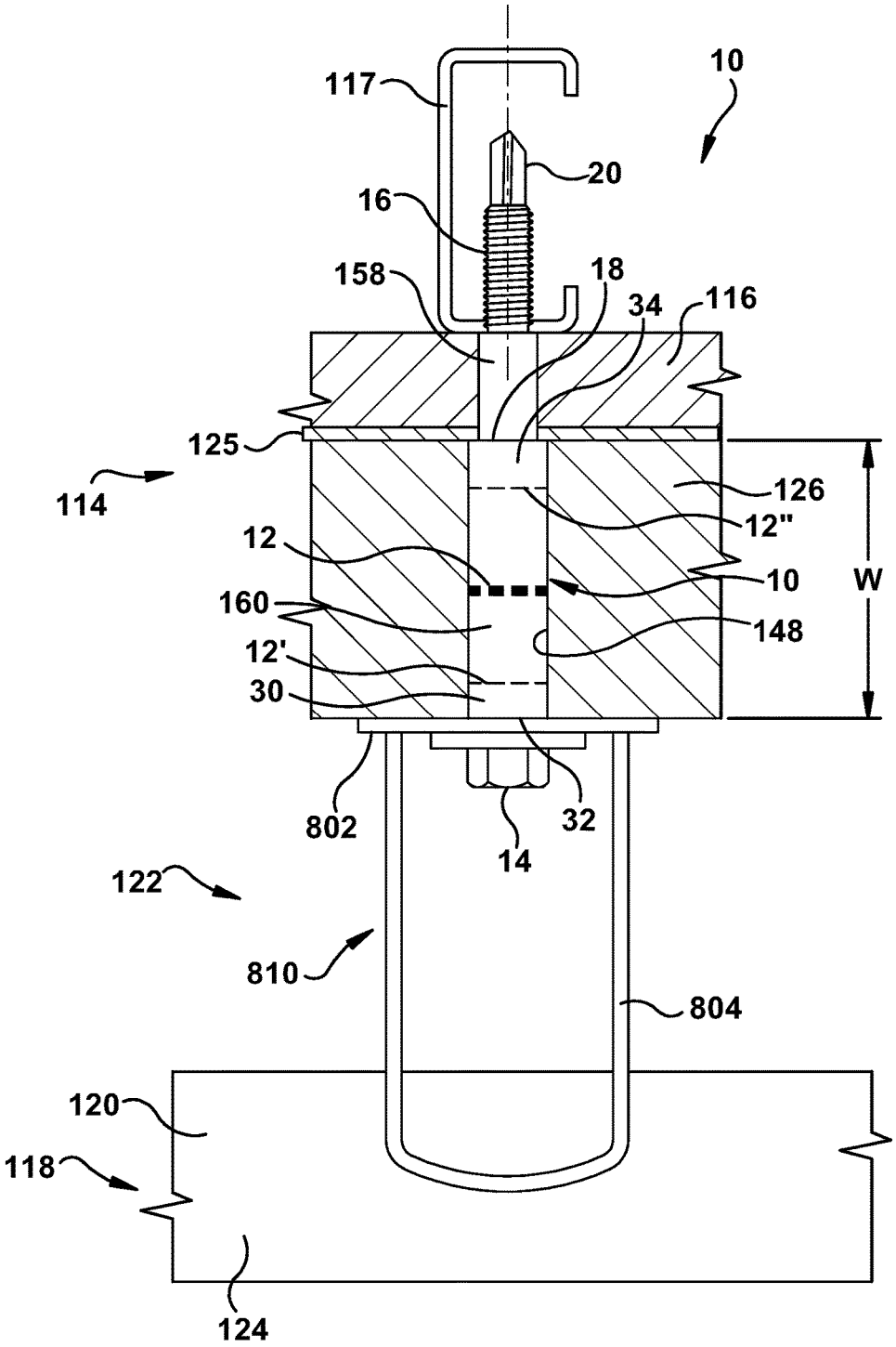
FIG. 10 is a cross-sectional view of FIG. 9 taken along an xz-plane including the longitudinal axis of the fastener.

FIGS. 9 and 10 illustrate a wall anchoring system 910 that uses fasteners 10 shown in FIGS. 1, 1A and/or 1B and the composite tie 840 illustrated by FIGS. 8A and 8B. A cavity wall assembly 112 is shown as having an inner wythe 114 constructed from one or more panels 116 or layers, which may be sheetrock, drywall, particle board, oriented strand board, fiberglass mats on the front and back of a fiberglass reinforced gypsum core, and/or any other wall construction panel or facing material, mounted on a support structure 117, such as metal studs or columns, wood studs or panels, or a masonry wall. Metal studs are illustrated, but inner wythes constructed of masonry materials and/or wood framing (not shown) are also applicable. The cavity wall assembly also includes an outer wythe or facing wall 118 of brick 120 construction. Between the inner wythe 114 and the outer wythe 118, a cavity 122 is formed. The cavity 122 has attached to the exterior surface 124 of the inner wythe 114 an optional air or air-vapor barrier 125 and insulation 126. The air or air-vapor barrier 125 and/or the panel 116 form an exterior layer of the inner wythe 114, which exterior layer has the insulation 126 disposed thereon.

Successive bed joints 130 and 132 may be substantially planar and horizontally disposed, in accord with current building standards. For example, the bed joints may be 0.375-inch (approx.) in height. Selective ones of bed joints 130 and 132, which are formed between courses of bricks 120, are constructed to receive a veneer anchor 140. The veneer anchor can take a wide variety of different forms. In the example illustrated by FIG. 2, any veneer anchor 140 capable of being mounted to the inner wythe 114 and insulation 126 with a conventional fastener can be mounted with one of the fasteners 10 having a thermal break 12 illustrated by FIGS. 1, 1A, and 1B. The tie retainer wire loop 804 is disposed on a course of bricks 120 in preparation for embedment in the mortar of bed joint 130.

Referring to FIGS. 9 and 10, at intervals along a horizontal surface 124, fasteners 10 are driven into place in holes 148 in the insulation. The ties 140 are positioned on surface 124 so that the longitudinal axis of wall anchor 140 is normal to an xy-plane and the fastener 10 taps into column 117.

For purposes of discussion, the cavity surface 124 of the inner wythe 114 contains a horizontal line or x-axis 134 and intersecting vertical line or y-axis 136. A horizontal line or z-axis 138, normal to the xy-plane, passes through the coordinate origin formed by the intersecting x- and y-axes. FIG. 10 is a sectional view taken through this xz plane. As can be seen in FIG. 10, the location of the thermal break 12 is inside the width W of the insulation 126 in an exemplary embodiment. This positioning of the thermal break 12 inside the insulation significantly reduces heat transfer from one side of the insulation to the other side of the insulation. For example, in the winter the temperature inside a building and thus the temperature of the support structure 117, such as a metal stud, may be a room temperature between 65 and 75 degrees F., while the temperature of the outer wythe 118 and the cavity 122 may be below freezing. If a conventional metal fastener that does not have a thermal break within the width of the insulation 126, heat will conduct from the support structure 117, such as a metal stud, directly through the fastener, to the head of the fastener, and be lost in the cavity 122 that is much colder than the support structure 117, By providing a fastener 10 with a thermal break 12 within the width of the insulation 126, heat will conduct from the support structure 117, such as a metal stud and into the fastener, but the thermal break substantially prevents heat from passing to the head of the fastener, and from being lost in the colder cavity 122.

In an exemplary embodiment, one or more thermal breaks 12 can be positioned anywhere in the insulation 126. In the example illustrated by FIG. 10, thermal break(s) can be positioned as indicated by reference numbers 12, 12' and/or 12". Any number of thermal breaks can be provided. In the illustrated embodiment, the fastener 10 includes a metallic portion 30 that extends into the insulation 126 from the outside 32 and a metallic portion 34 that extends into the insulation 126 from the inside, with one or more thermal breaks 12, 12', and/or 12" disposed completely in the insulation.

The thermal break 12 can take a wide variety of different forms. For example, two or more parts of the fastener 10 can be connected by a material having a low thermal conductivity to form the thermal break 12. For example, the two or more parts can be connected together by an epoxy or other adhesive having a low thermal conductivity, mechanically connected together, for example by one or more threaded connectors having a low thermal conductivity, and the like. Any manner for providing a thermal break can be implemented. In another exemplary embodiment, the entire fastener 10 is made from a material having a low thermal conductivity, rather than providing a thermal break.

Figure 11:
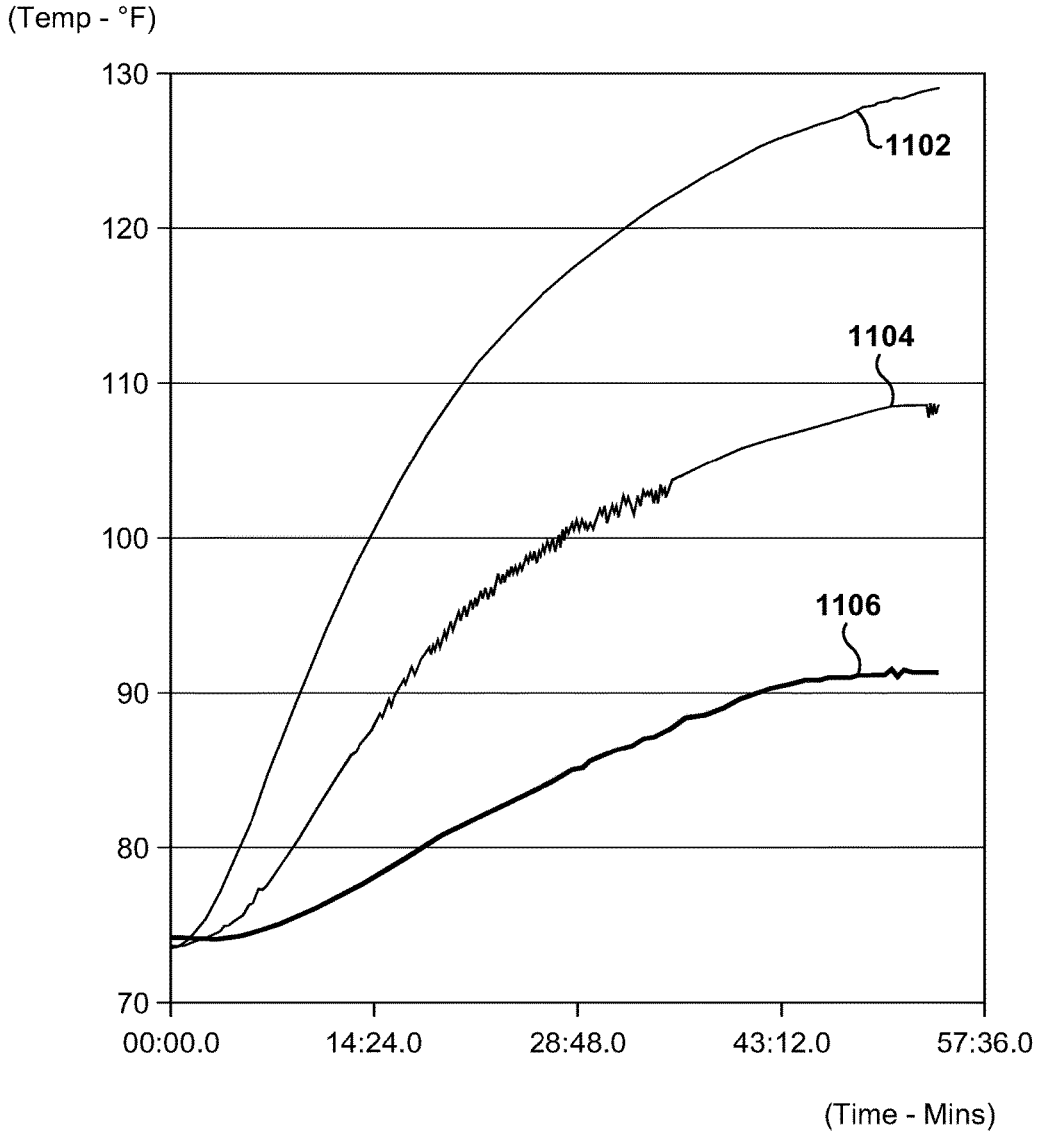
FIG. 11 is a graph that plots Temperature vs. Time of a steel stud, a standard fastener and tie, and a fastener with a thermal break positioned inside the insulation and a tie.

FIG. 11 is a graph that represents results of a test that was run on a fastener 10 used in the anchoring systems 110 illustrated by FIGS. 3, 7, and 10. In the test, a metal stud 117 is made from steel and is heated. The line 1102 on the graph represents the temperature of the steel stud. Two fasteners are attached to the metal stud. The first fastener is made from steel and does not include a thermal break. The second fastener is also made from steel, but has a thermal break about midway through the thickness of the insulation. The line 1104 on the graph represents the temperature of the head of the steel fastener without a thermal break. The line 1106 on the graph represents the temperature of the head of the steel fastener with a thermal break positioned in the insulation 126. As can be seen in FIG. 11, the drop in temperature from the stud to the fastener head is much greater when the fastener includes a thermal break inside the thickness of the insulation. In the example illustrated by FIG. 11, the temperature drop from the steel stud 117 to the fastener head 14 doubles, at least doubles, or approximately doubles when a thermal break inside the insulation is included. In the example illustrated by FIG. 11, the temperature drop for a steel fastener without a thermal break is about 20 degrees F. (About 130 degrees F. minus about 110 degrees F.) and the temperature drop for a steel fastener with a thermal break is about 40 degrees (About 130 degrees minus about 90 degrees). As such, the inclusion of a thermal break in a steel fastener inside the width of the insulation significantly reduces the thermal conductivity of the fastener 10.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, hardware, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

While the present invention has been illustrated by the description of embodiments thereof, and while the embodiments have been described in considerable detail, it is not the intention of the applicant to restrict or in any way limit the scope of the invention to such detail. Additional advantages and modifications will readily appear to those skilled in the art. For example, the specific locations of the component connections and interplacements can be modified. Therefore, the invention, in its broader aspects, is not limited to the specific details, the representative apparatus, and illustrative examples shown and described. Accordingly, departures can be made from such details without departing from the spirit or scope of the applicant's general inventive concept.

The invention claimed is:

1. A cavity wall assembly comprising:

a support structure;

insulation mounted to the support structure;

an outer wythe spaced apart from the insulation, such that a cavity is formed between the insulation and the outer wythe;

a fastener having a conductive head, wherein the fastener extends through the insulation and into the support structure, wherein more than one portion of the fastener is made from at least one material having low thermal conductivity, wherein the more than one portion of the fastener forms a plurality of primary thermal breaks located inside a width of the insulation;

an enlarged disk integral with the conductive head of the fastener, wherein the enlarged disk is made from a substantially non-thermally conductive material, wherein the enlarged disk forms a secondary thermal break outside the width of insulation, wherein a diameter of the enlarged disk is at least twice as large as a maximum dimension of the conductive head of the fastener; and a separate tie retainer connected to and extending away from the enlarged disk.

2. The cavity wall assembly of claim 1, wherein the support structure comprises a plurality of metal studs.

3. The cavity wall assembly of claim 2, wherein one or more panels are mounted between the metal studs and the insulation.

4. The cavity wall assembly of claim 3, wherein a vapor barrier is disposed on the panels.

5. The cavity wall assembly of claim 1, wherein the fastener is molded from a plastic.

6. The cavity wall assembly of claim 1, wherein the fastener further includes a first metallic portion that extends into the insulation from a first side of the insulation and a second metallic portion that extends into the insulation from a second side of the insulation opposite the first side.

7. A retaining device comprising:

a fastener for extending through a width of an insulation, the fastener having a threaded portion, a shank, and a conductive head, wherein more than one portion of the fastener is made from at least one material having low thermal conductivity, wherein the more than one portion of the fastener forms a plurality of primary thermal breaks inside the width of the insulation;

a disk integral with the conductive head of the fastener, wherein a diameter of the disk is at least twice as large as a maximum dimension of the conductive head of the fastener; and a separate tie retainer connected to and extending away from the disk, wherein the disk and the tie retainer are made from a material that is substantially non-thermally conductive, the disk and tie retainer collectively forming a secondary thermal break outside the width of insulation.

8. The retaining device of claim 7, wherein the fastener further includes a first metallic portion that extends into the insulation from a first side of the insulation and a second metallic portion that extends into the insulation from a second side of the insulation opposite the first side.

9. A composite masonry tie comprising:

a fastener for extending through a width of an insulation, the fastener having a threaded portion, a shank, and a conductive head, wherein more than one portion of the fastener is made from at least one material having low thermal conductivity, wherein the more than one portion of the fastener forms a plurality of primary thermal breaks inside the width of the insulation;

a disk, wherein the conductive head engages the disk and the disk is integral with the conductive head of the fastener, wherein a diameter of the disk is at least twice as large as a maximum dimension of the conductive head of the fastener; and a wire loop connected to and extending away from the disk;

wherein the disk is made from a material that is substantially non-thermally conductive to provide a secondary thermal break located between the fastener and the wire loop.

10. The composite masonry tie of claim 9, wherein the fastener further includes a first metallic portion that extends into the insulation from a first side of the insulation and a second metallic portion that extends into the insulation from a second side of the insulation opposite the first side.

* * * * *